United States Patent [19]

Simpson

[11] 4,341,921

[45] Jul. 27, 1982

[54] COMPOSITE CONNECTOR HAVING HEAT SHRINKABLE TERMINATOR

[75] Inventor: Damon G. Simpson, Los Altos, Calif.

[73] Assignee: Raychem Corporation, Menlo Park, Calif.

[21] Appl. No.: 134,356

[22] Filed: Mar. 27, 1980

[51] Int. Cl.[3] ..... H01R 4/70

[52] U.S. Cl. ..... 174/84 R; 174/DIG. 8

[58] Field of Search ..... 174/DIG. 8, 84 R; 339/DIG. 1

[56] References Cited

U.S. PATENT DOCUMENTS

| | | | |
|---|---|---|---|
| 3,243,211 | 3/1966 | Wetmor . | |
| 3,305,625 | 2/1967 | Ellis | 174/DIG. 8 X |
| 3,324,230 | 6/1967 | Sherlock . | |
| 3,525,799 | 8/1970 | Ellis | 174/84 |
| 3,541,495 | 11/1970 | Ellis et al. | 339/177 |
| 3,708,611 | 1/1973 | Dinger | 174/84 C |
| 4,077,692 | 3/1978 | Ellis . | |
| 4,151,364 | 4/1979 | Ellis . | |
| 4,246,438 | 1/1981 | Gozlan | 174/DIG. 8 X |
| 4,282,396 | 8/1981 | Watine et al. | 174/84 R |

FOREIGN PATENT DOCUMENTS 2809461 4/1978 Fed. Rep. of Germany .

*Primary Examiner*—Roy N. Envall, Jr.
*Attorney, Agent, or Firm*—Derek P. Freyberg

[57] ABSTRACT

A composite connector for electrical conductors has a heat-shrinkable terminator for each conductor. Each terminator is secured to the connector body, and a guide and stop for each conductor are formed within each terminator. The method of manufacture involves the shrinkage of each terminator over the connector body and a forming mandrel.

10 Claims, 11 Drawing Figures

PRIOR ART

COMPOSITE CONNECTOR HAVING HEAT SHRINKABLE TERMINATOR

FIELD OF THE INVENTION

This invention relates to an improved composite connector for electrical conductors possessing heat-shrinkable termination means.

BRIEF DESCRIPTION OF THE DRAWING

FIG. 1 is a cross-sectional view of the assembled connector and heat-shrinkable terminator of the prior art, while FIGS. 2 through 5 depict in cross-sectional view various of the difficulties associated with the use of the assembly of FIG. 1.

FIG. 6 is a cross-sectional view of the composite connector of this invention. FIGS. 7 and 8 show in cross-sectional view the method of forming the composite connector using a forming mandrel. FIGS. 9 through 11 show in cross-sectional view the use of the composite connector of this invention for the termination of a wire.

BACKGROUND OF THE INVENTION

Insulated conductors (wires) are generally terminated to connector contacts by crimping, welding, or soldering. Due to the close spacing of contacts in a connector, the crimping method requires contacts that are crimped onto the conductors before the contacts are inserted and locked to the connector body. Welded or soldered terminations can be made on contacts molded into the connector body; however, the welding technique requires more sophisticated equipment than soldering and its reliability suffers with variations in wire size (mass).

Soldering is thus a very popular method of terminating connectors. However, because of the craft-sensitivity of hand soldering techniques, many commercial applications now use heat-shrinkable terminators, which provide a controlled amount of solder and flux for each wire termination. Such terminators are especially suitable when a plurality of wires are to be simultaneously terminated onto a connector. Terminators suitable for this purpose have been described in, for example, U.S. Pat. Nos. 3,243,211 and 3,305,625, the disclosures of which are incorporated herein by reference.

Figure 1:
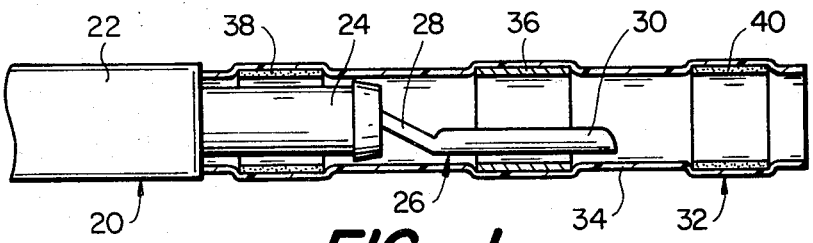
FIGS. 1 through 5 represent the prior art.

FIG. 1 shows in cross-section the assembly of a connector and a heat-shrinkable terminator of the prior art. The connector shown generally at 20 comprises a connector body 22, a terminal boss 24, and a terminal shown generally at 26, comprising a terminal shank 28 and a terminal blade 30. An electrical contact extends through the connector body and terminal boss, with one end being formed into the terminal 26, and the other end being located for facile connection with a compatible connector. A terminator shown generally at 32, comprising a heat-shrinkable polymeric insulating sleeve 34, fluxed solder ring 36, and thermoplastic environmental seals 38 and 40, is placed over the boss 24. In normal operation, a wire, of which the end portion of the conductor is exposed, is inserted into the terminator, and the assembly is heated to form a sealed, strain-relieved, soldered termination to the connector.

Figure 2:
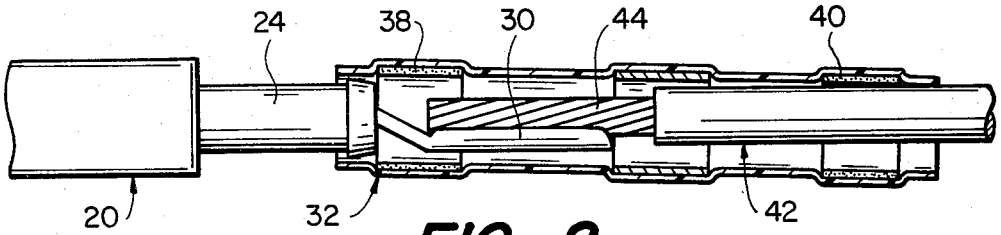
FIG 2 PRIOR ART
Figure 3:
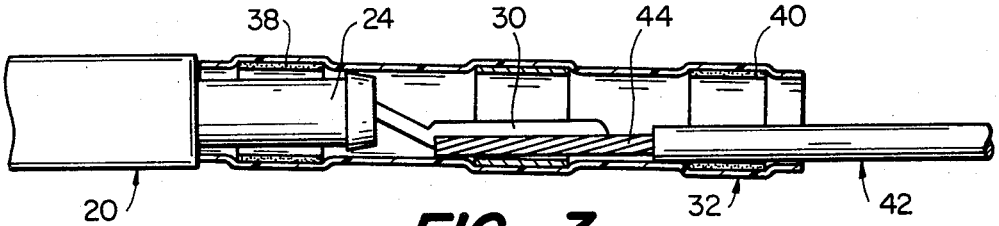
FIG 3 PRIOR ART
Figure 4:
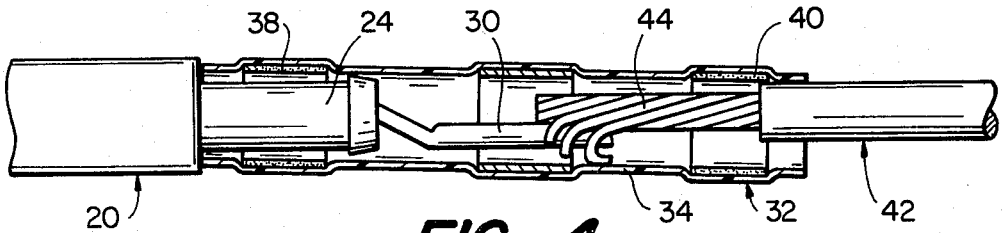
FIG 4 PRIOR ART
Figure 5:
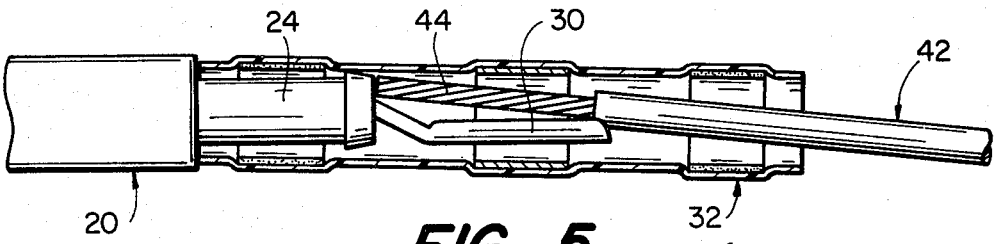
FIG 5 PRIOR ART

There are, however, a number of potential problems associated with the use of the assembly of FIG. 1, four of which are shown in FIGS. 2–5. In FIG. 2, although the conductor 44 has been correctly placed on the terminal blade 30, the heat-shrinkable terminator 32 has substantially slipped off the terminal boss 24, so that environmental seal 38 will not seal to the boss 24 if the terminator is heated. In FIG. 3, a wire shown generally at 42 having conductor 44 has been inserted into the assembly, but the conductor 44 is on the underside of the terminal blade 30. The risk of this occurrence is greatest with relatively thin wires. In FIG. 4, conductor 44 of wire 42 has become splayed from hitting the end of terminal blade 30. Not only is insertion of the wire incomplete, but the splayed ends of the conductor may puncture or split the polymeric insulating sleeve 34. This can lead to further splitting of the sleeve as it is heat-shrunk. The risk of this occurrence is greatest with thicker wires. In FIG. 5, wire 42 has been over-inserted so as to touch terminal boss 24, leaving a substantial gap between conductor 44 and terminal blade 30.

In each of the cases described above, a poor termination will result. The problem is especially acute when a plurality of wires are to be terminated simultaneously, and when the wires are of different sizes and degrees of stiffness. If a poor termination should be formed, it must be unsoldered, taking care not to affect adjacent terminations, and resoldered using a new terminator. This requires both care and time, and decreases productivity.

The use of an integrally formed connector, such as that described in U.S. Pat. No. 4,077,692, the disclosure of which is incorporated herein by reference, will avoid the disadvantage shown in FIG. 2, as the heat-shrinkable terminator portion is manufactured integrally with the rigid connector body. However, the possibility of mislocation of the conductor, as depicted in FIGS. 3, 4, and 5, still remains. Furthermore, such integrally formed connectors are substantially more expensive than the component parts, i.e. a connector and a suitable number of terminators, required by the usual method.

SUMMARY OF THE INVENTION

The present invention provides an improved composite connector for electrical conductors having a heat-shrinkable terminator, which terminator has formed within it guide means and stop means. This invention further provides a method of manufacturing this composite connector, which comprises the shrinkage over a forming mandrel of the heat-shrinkable terminator portion of the connector.

DESCRIPTION OF THE PREFERRED EMBODIMENT

Figure 6:
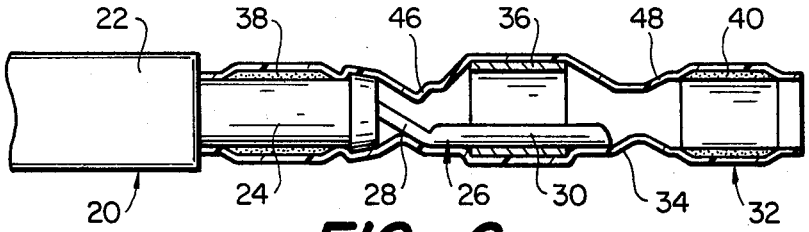
FIGS. 6 through 11 represent the present invention.

FIG. 6 shows in cross-section the improved composite connector of this invention. The connector shown generally at 20 comprises a connector body 22, terminal boss 24, and a terminal shown generally at 26, comprising terminal shank 28 and terminal blade 30; where an electrical contact extends through the connector body and terminal boss, with one end being formed into the terminal 26, and the other end being located for facile connection with a compatible connector; while the heat-shrinkable terminator shown generally at 32 comprises a heat-shrinkable polymeric insulating sleeve 34, fluxed solder ring 36, and thermoplastic environmental seals 38 and 40. By contrast with the prior art assembly of FIG. 1, sleeve 34 is selectively shrunk so that environmental seal 38 is flowed and sealed onto terminal boss 24 and stop means 46, which prevents over-insertion of a conductor, and guide means 48, which ensure that the conductor will be correctly aligned with the terminal blade 30, are formed in sleeve 34.

Figure 7:
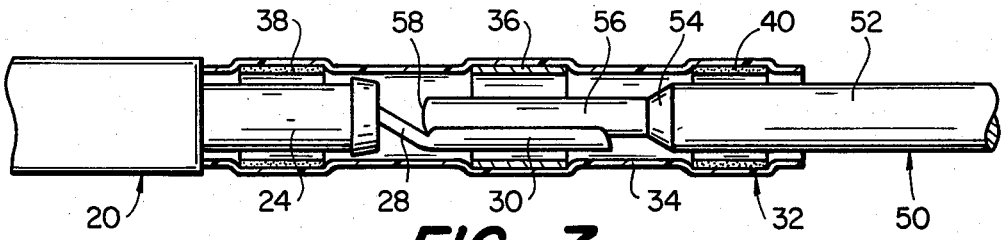
Figure 8:
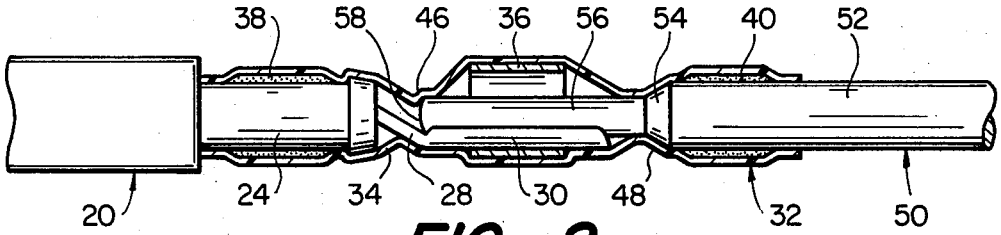

FIGS. 7 and 8 depict the method of manufacture of the composite connector. In FIG. 7, a forming mandrel shown generally at 50, which has broad section 52, tapered section 54, narrow section 56 and end 58, has been inserted into terminator 32 which has been positioned such that seal 38 lies over terminal boss 24 and solder ring 36 lies over terminal blade 30. In FIG. 8, on the application of heat sufficient to melt seals 38 and 40 and shrink sleeve 34 but not to fuse solder ring 36, sleeve 34 shrinks about boss 24, solder ring 36, and mandrel 50. Seal 38 flows to form a tight fit about boss 24 while sleeve 34 deforms so as to create stop means 46, which can prevent over-insertion of a conductor, at the end 58 of the mandrel and guide means 48, which can ensure that the conductor will be inserted into correct alignment with the terminal blade 30, onto tapered section 54 of the mandrel. After the connector and mandrel have cooled below the softening point of sleeve 34, the mandrel is removed to leave the composite connector of FIG. 6.

Figure 9:
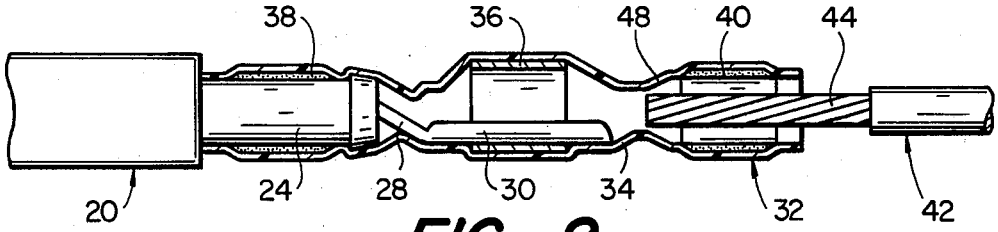
Figure 10:
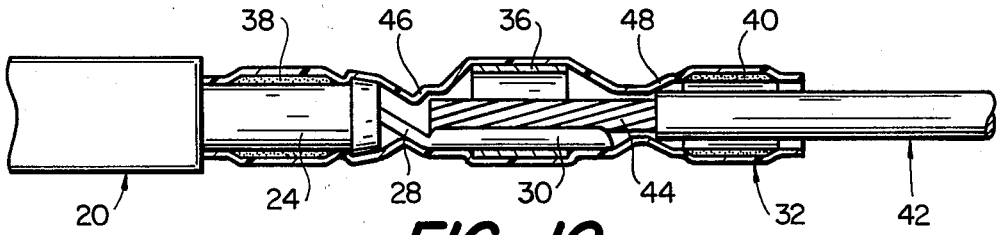
Figure 11:
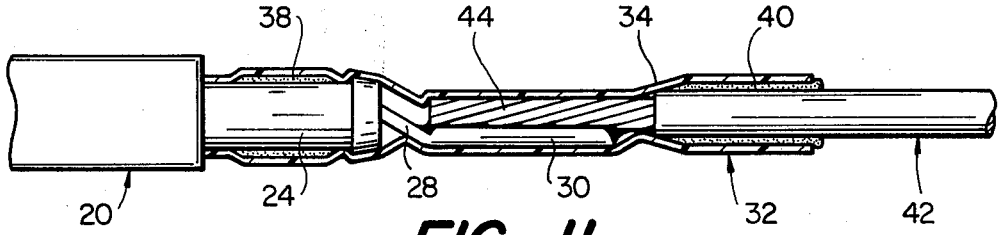

FIGS. 9 through 11 illustrate the use of the composite connector of this invention. In FIG. 9 conductor 44 of wire 42 is shown entering the guide means 48. Guide means 48 can prevent the end of conductor 44 from hitting the end of terminal blade 30, so that correct insertion is assured. FIG. 10 shows the wire correctly located with the end of conductor 44 against the stop means 46. FIG. 11 depicts the method of completing the connection. On the application of sufficient heat, solder ring 36 and seal 40 have each melted and flowed, and sleeve 34 has shrunk so that a strain relieved, soldered joint results.

This invention thus provides a new and improved composite connector for electrical conductors which employs a conventional connector and terminators and which yet, by the provision of guide and stop means, is superior even to integrally formed connectors. While and embodiment and application of this invention have been shown, it would be apparent to those skilled in the art that modifications are possible without departing from the inventive concepts herein described. The invention, therefore, is not to be restricted except by the spirit of the appended claims.

I claim:

1. A composite electrical connector, comprising:

(a) a rigid connector body adapted for connection to a compatible connector and having at least one conductor termination portion, each said conductor termination portion comprising a terminal boss extending from said connector body and having a terminal protruding from the end thereof; and (b) a heat-shrinkable terminator for each said conductor termination portion, each said terminator comprising a heat-shrinkable polymeric sleeve having inner, center, and outer sections in axially aligned abutting relationship; wherein (i) said inner section contains a first thermoplastic environmental seal ring located coaxially within said sleeve;

(ii) said center section contains a fluxed solder ring located coaxially within said sleeve;

(iii) said sleeve is positioned such that said inner section and said first seal ring lie about said terminal boss and said inner section is sealed to said terminal boss by said first seal ring, and said solder ring lies about said terminal;

(iv) stop means to prevent overinsertion of a conductor entering said terminator through said outer and center sections, said stop means being integrally formed within said sleeve and located between said end of said terminal boss and said solder ring; and (v) guide means to correctly align a conductor entering said terminator through said outer section with respect to said terminal, said guide means being integrally formed within said sleeve and located on that side of said solder ring remote from said first seal ring.

2. A composite electrical connector as claimed in claim 1 wherein each said heat-shrinkable terminator additionally comprises a second thermoplastic environmental seal ring located coaxially within said outer section of said polymeric sleeve on that side of said guide means remote from said solder ring.

3. A composite electrical connector as claimed in claim 1 further comprising an electrical contact extending from each said terminal through each said terminal boss and said connector body for facile union with contacts of a compatible connector.

4. A composite electrical connector as claimed in claim 2 further comprising an electrical contact extending from each said terminal through each said terminal boss and said connector body for facile union with contacts of a compatible connector.

5. A method of manufacture of a composite electrical connector, which comprises:

(a) selecting an electrical connector comprising a rigid connector body and at least one conductor termination portion, each said conductor termination portion comprising a terminal boss extending from said connector body and having a terminal protruding from the end thereof;

(b) placing about each said conductor termination portion a heat-shrinkable terminator, each said terminator comprising a heat-shrinkable polymeric sleeve having inner, center, and outer sections in axially aligned abutting relationship, wherein said inner section contains a first thermoplastic environmental seal ring located coaxially within said sleeve, and said center section contains a fluxed solder ring located coaxially within said sleeve, such that said inner section and said first seal ring lie about said terminal boss and said solder ring lies about said terminal;

(c) inserting into each said heat-shrinkable terminator a metallic mandrel comprising a broad part, a tapered part, and a narrow part, such that said narrow part lies adjacent to said terminal and within said solder ring;

(d) heating each said heat-shrinkable terminator to a temperature such that said first thermoplastic environmental seal fuses and said polymeric sleeve shrinks but that said solder ring remains rigid, thereby (i) sealing said inner section to said terminal boss, (ii) forming integrally within said sleeve stop means to prevent over-insertion of a conductor entering said terminator through said center and outer sections located between said end of said terminal boss and said solder ring, and (iii) forming integrally within said sleeve guide means to correctly align a conductor entering said terminator through said outer section with respect to said terminal located on that side of said solder ring remote from said first seal ring;

(e) cooling each said terminator to below the softening point of the material of said polymeric sleeve and said first seal ring; and (f) removing each said mandrel from each said terminator.

6. A composite electrical connector, comprising:

(a) a rigid connector body adapted for connection to a compatible connector and having at least one conductor termination portion, each said conductor termination portion comprising a terminal boss extending from said connector body and having a terminal protruding from the end thereof, each said terminal comprising a shank and a blade; and (b) a heat-shrinkable terminator for each said conductor termination portion, each said terminator comprising a heat-shrinkable polymeric sleeve having inner, center, and outer sections in axially aligned abutting relationship; wherein (i) said inner section contains a first thermoplastic environmental seal ring located coaxially within said sleeve;

(ii) said center section contains a fluxed solder ring located coaxially within said sleeve;

(iii) said sleeve is positioned such that said inner section and said first seal ring lie about said terminal boss and said inner section is sealed to said terminal boss by said first seal ring, and said solder ring lies about said terminal blade;

(iv) stop means to prevent over-insertion of a conductor entering said terminator through said outer and center sections, said stop means being integrally formed within said sleeve and located between said end of said terminal boss and said solder ring and about said terminal shank; and (v) guide means to correctly align a conductor entering said terminator through said outer section with respect to said terminal blade, said guide means being integrally formed within said sleeve and located on that side of said solder ring remote from said first seal ring.

7. A composite electrical connector as claimed in claim 6 wherein each said heat-shrinkable terminator additionally comprises a second thermoplastic environmental seal ring located coaxially within said outer section of said polymeric sleeve on that side of said guide means remote from said solder ring.

8. A composite electrical connector as claimed in claim 6 further comprising an electrical contact extending from each said terminal through said terminal boss and said connector body for facile union with contacts of a compatible connector.

9. A composite electrical connector as claimed in claim 7 further comprising an electrical contact extending from each said terminal through said terminal boss and said connector body for facile union with contacts of a compatible connector.

10. A method of manufacture of a composite electrical connector, which comprises:

(a) selecting an electrical connector comprising a rigid connector body and at least one conductor termination portion, each said conductor termination portion comprising a terminal boss extending from said connector body and having a terminal protuding from the end thereof, each said terminal comprising a shank and a blade;

(b) placing about each said conductor termination portion a heat-shrinkable terminator, each said terminator comprising a heat-shrinkable polymeric sleeve having inner, center, and outer sections in axially aligned abutting relationship, wherein said inner section contains a first thermoplastic environmental seal ring located coaxially within said sleeve, and said center section contains a fluxed solder ring located coaxially within said sleeve, such that said inner section and said first seal ring lie about said terminal boss and said solder ring lies about said terminal blade;

(c) inserting into each said heat-shrinkable terminator a metallic mandrel comprising a broad part, a tapered part, and a narrow part, such that said narrow part lies adjacent to said terminal and within said solder ring;

(d) heating each said heat-shrinkable terminator to a temperature such that said first thermoplastic environmental seal fuses and said polymeric sleeve shrinks but that said solder ring remains rigid, thereby (i) sealing said inner section to said terminal boss, (ii) forming integrally within said sleeve stop means to prevent over-insertion of a conductor entering said terminator through said outer and center sections located between said end of said terminal boss and said solder ring and about said terminal shank, and (iii) forming integrally within said sleeve guide means to correctly align a conductor entering said terminator through said outer section sith respect to said terminal blade located on that side of said solder ring remote from said first seal ring;

(e) cooling each said terminator to below the softening point of the material of said polymeric sleeve and said first seal ring; and (f) removing each said mandrel from each said terminator.

* * * * *